US012669121B2

(12) United States Patent
Ramm et al.

(10) Patent No.: US 12,669,121 B2
(45) Date of Patent: Jun. 30, 2026

(54) ROTOR PUMP WITH DUAL-SIDED INLETS

(71) Applicant: Joby Aero, Inc., Santa Cruz, CA (US)

(72) Inventors: Robert Ramm, Woodside, CA (US); Liam Chaffey, Monterey, CA (US)

(73) Assignee: Joby Aero, Inc., Santa Cruz, CA (US)

( * ) Notice: Subject to any disclaimer, the term of this patent is extended or adjusted under 35 U.S.C. 154(b) by 7 days.

(21) Appl. No.: 18/955,630

(22) Filed: Nov. 21, 2024

(65) Prior Publication Data

US 2025/0163911 A1 May 22, 2025

Related U.S. Application Data

(60) Provisional application No. 63/601,488, filed on Nov. 21, 2023.

(51) Int. Cl.
*F04C 2/10* (2006.01)
*F04C 15/06* (2006.01)

(52) U.S. Cl.
CPC ..... *F04C 2/103* (2013.01); *F04C 15/06* (2013.01)

(58) Field of Classification Search
CPC ..... F04C 15/06; F04C 2/102; F04C 2/103; F04C 2230/91; F04C 2240/30; F05C 2201/021
See application file for complete search history.

(56) References Cited

U.S. PATENT DOCUMENTS

2020/0158106 A1* 5/2020 Melo ..... F04C 11/003

FOREIGN PATENT DOCUMENTS

CA 2979688 C * 9/2021 ..... F04C 13/008

OTHER PUBLICATIONS

CA-2979688-C English Translation (Year: 2021).*

* cited by examiner

*Primary Examiner* — Anthony Ayala Delgado
(74) *Attorney, Agent, or Firm* — SCHWEGMAN LUNDBERG & WOESSNER, P.A.

(57) ABSTRACT

A fluid pump includes a housing having a pump inlet volume and a pump outlet volume defined therein, an outer gerotor located in the housing, and an inner gerotor located in the housing inside the outer gerotor. The inner and outer gerotors being in fluid communication with the pump inlet volume and the pump outlet volume, and a first inlet and a second, separate inlet are provided in fluid communication with the inlet volume of the housing.

19 Claims, 8 Drawing Sheets

ROTOR PUMP WITH DUAL-SIDED INLETS

RELATED APPLICATION DATA

This application claims the benefit of U.S. Application Ser. No. 63/601,488 filed Nov. 21, 2023, the contents of which are incorporated herein by reference as if explicitly set forth.

TECHNICAL FIELD

This invention relates generally to fluid pumps for transportation, and more specifically in some examples to a new and useful gerotor pump and fan combination for use in the aviation field.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
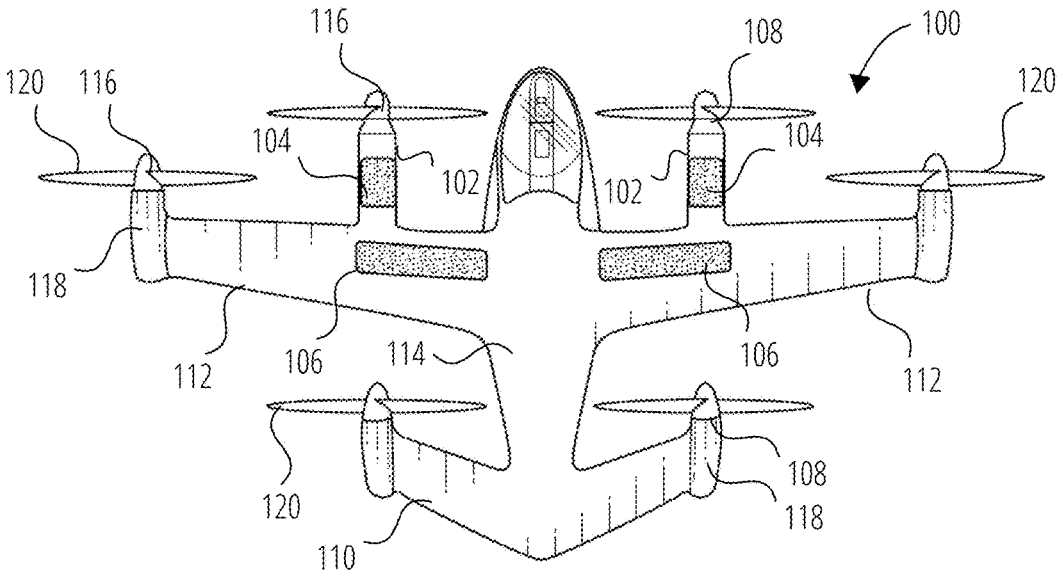
FIG. 1 is a plan view of an aircraft according to some examples.

FIG. 1 is a plan view of an aircraft 100. The aircraft 100 includes a fuselage 114, two wings 112, an empennage 110, propulsion systems 108 embodied as tiltable rotor assemblies 116 located in nacelles 118, and rotors 120. The aircraft 100 includes one or more power sources embodied in FIG. 1 as nacelle battery packs 104 and wing battery packs 106. In the illustrated example, the nacelle battery packs 104 are located in inboard nacelles 102, but of course it will be appreciated that the nacelle battery packs 104 could be located in other nacelles 118 forming part of the aircraft 100. The battery packs form part of the energy system 200 described with reference to FIG. 2. The aircraft 100 will typically include associated equipment such as an electronic infrastructure, control surfaces, a cooling system, landing gear and so forth.

The wings 112 function to generate lift to support the aircraft 100 during forward flight. The wings 112 can additionally or alternately function to structurally support the battery packs 202, battery module 204 and/or propulsion systems 108 under the influence of various structural stresses (e.g., aerodynamic forces, gravitational forces, propulsive forces, external point loads, distributed loads, and/or body forces, etc.). The wings 112 can have any suitable geometry and/or arrangement on the aircraft.

Figure 2:
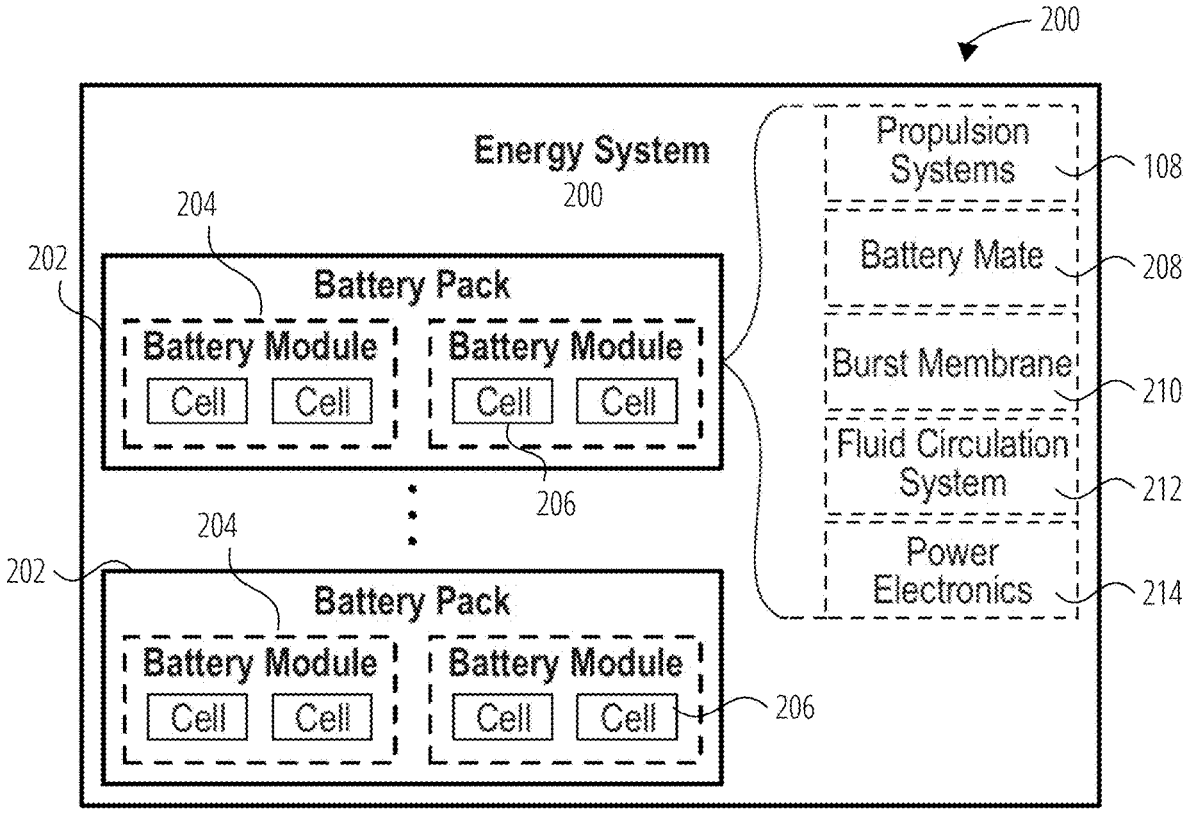
FIG. 2 is a schematic view of an aircraft energy system for use in the aircraft of FIG. 1, according to some examples.

FIG. 2 is a schematic view of an aircraft energy system 200 for use in the aircraft 100 of FIG. 1, according to some examples. As shown, the energy system 200 includes one or more battery packs 202. Each battery pack 202 may include one or more battery modules 204, which in turn may comprise a number of cells 206.

Typically associated with a battery pack 202 are one or more electric propulsion systems 108, a battery mate 208 for connecting it to other components in energy system 200, a burst membrane 210 as part of a venting system, a fluid circulation system 212 for cooling, and power electronics 214 for regulating delivery of electrical power (from the battery during operation and to the battery during charging) and to provide integration of the battery pack 202 with the electronic infrastructure of the energy system 200. As shown in FIG. 1, the propulsion systems 108 may comprise a plurality of rotor assemblies.

The electronic infrastructure and the power electronics 214 can additionally or alternately function to integrate the battery packs 202 into the energy system of the aircraft. The electronic infrastructure can include a Battery Management System (BMS), power electronics (HV architecture, power components, etc.), LV architecture (e.g., vehicle wire harness, data connections, etc.), and/or any other suitable components. The electronic infrastructure can include inter-module electrical connections, which can transmit power and/or data between battery packs and/or modules. Inter-modules can include bulkhead connections, bus bars, wire harnessing, and/or any other suitable components.

The battery packs 202 function to store electrochemical energy in a rechargeable manner for supply to the propulsion systems 108. Battery packs 202 can be arranged and/or distributed about the aircraft in any suitable manner. Battery packs can be arranged within wings (e.g., inside of an airfoil cavity), inside nacelles, and/or in any other suitable location on the aircraft. In a specific example, the system includes a first battery pack within an inboard portion of a left wing and a second battery pack within an inboard portion of a right wing. In a second specific example, the system includes a first battery pack within an inboard nacelle of a left wing and a second battery pack within an inboard nacelle of a right wing. Battery packs 202 may include a plurality of battery modules 204.

The energy system 200 includes a cooling system (e.g. fluid circulation system 212) that functions to circulate a working fluid within the battery pack 202 to remove heat generated by the battery pack 202 during operation or charging. Battery cells 206, battery module 204 and/or battery packs 202 can be fluidly connected by the cooling system in series and/or parallel in any suitable manner.

Figure 3A:
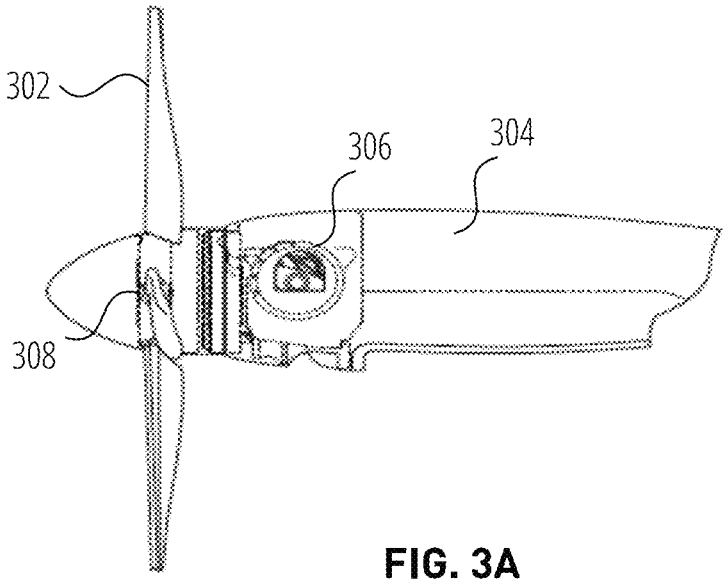
FIG. 3A, FIG. 3B and FIG. 3C illustrate the tilting of an aircraft propulsion system and related components such as a propeller and nacelle according to some examples.
Figure 3B:
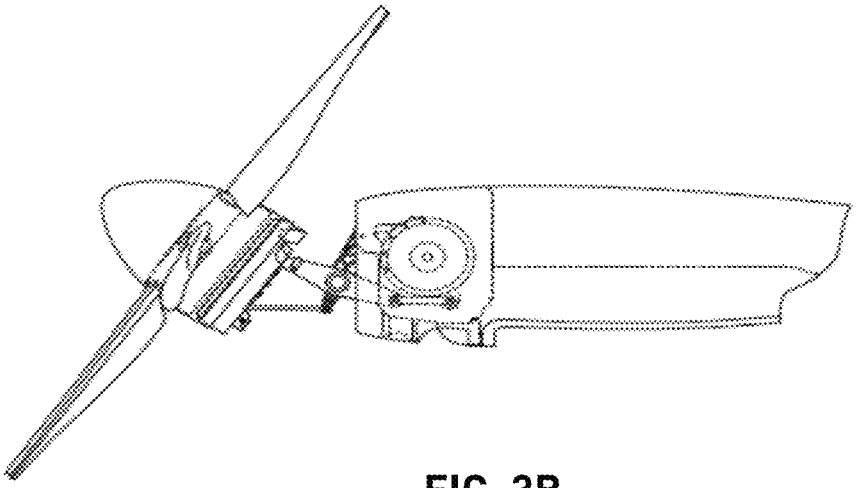
Figure 3C:
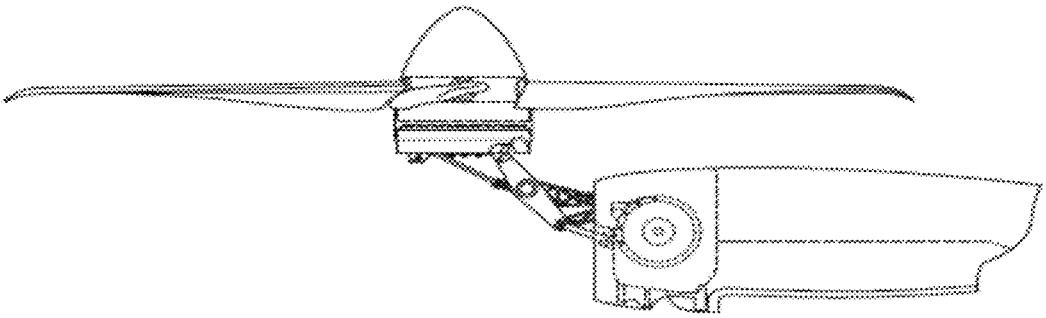

FIG. 3A, FIG. 3B and FIG. 3C illustrate the tilting of the aircraft propulsion system 500 and related components such as the propeller 402 relative to a nacelle 304 according to some examples. As can be seen in FIG. 3B and FIG. 3C, in this example the aircraft propulsion system 500 and a propeller 302 with a blade-pitching mechanism 308 are tilted relative to the nacelle 304 by a tilt mechanism 306 located towards the front of the nacelle 304.

As can be seen in FIG. 3C, which is a hovering configuration, the radiator 508 is exposed to the open air as opposed to being contained within the nacelle 304 as in the vertical configuration. This results in more airflow through the radiator 508 both from the fan and as a result of adjacent airflow from the propeller 402. Since hovering has a higher power requirement than level flight, the additional cooling provided by the increased airflow through the radiator 508 can be advantageous.

Figure 4A:
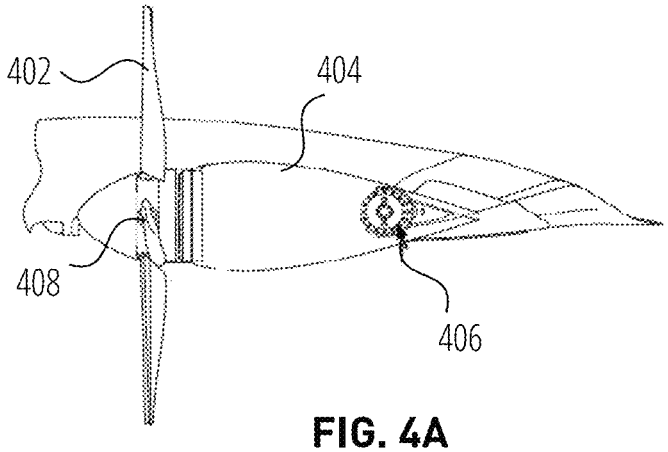
FIG. 4A, FIG. 4B and FIG. 4C illustrate the tilting of an aircraft propulsion system and related components such as a propeller and nacelle according to some examples.
Figure 4B:
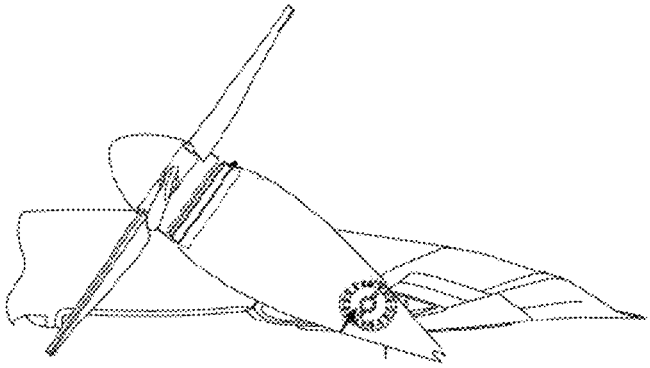
Figure 4C:
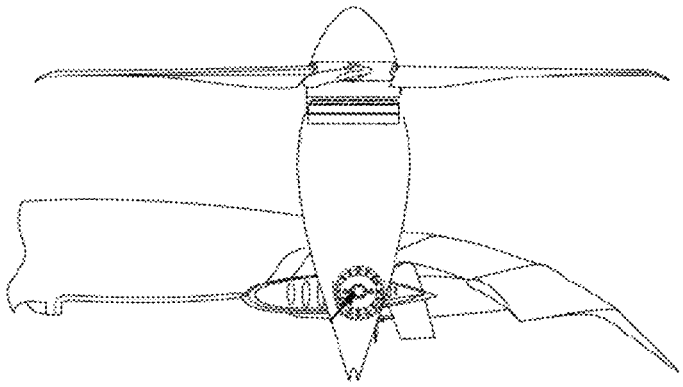

FIG. 4A, FIG. 4B and FIG. 4C illustrate the tilting of an aircraft propulsion system 500 (see FIG. 5) including related components such as a propeller 402 and a nacelle 404 according to some examples. The aircraft is preferably an eVTOL airplane (e.g., a multi-modal aircraft) as illustrated, but can additionally or alternatively include any suitable aircraft. The aircraft 100 is preferably a tiltrotor aircraft with a plurality of aircraft propulsion systems that are operable between a forward arrangement (FIG. 4A, and FIG. 3A) and a hover or vertical flight arrangement (FIG. 4C and FIG. 3C). However, the aircraft can alternatively be a fixed wing aircraft with one or more rotor assemblies or propulsion systems, a helicopter with one or more rotor assemblies (e.g., wherein at least one rotor assembly or aircraft propulsion system is oriented substantially axially to provide horizontal thrust), a tiltwing aircraft, a wingless aircraft (e.g., a helicopter, multi-copter, quadcopter), and/or any other suitable rotorcraft or vehicle propelled by propellers or rotors.

As shown in FIG. 4A to FIG. 4C, in one example a nacelle 404 including the aircraft propulsion system 500 and a propeller 402 with a blade-pitching mechanism 408 are tilted relative to the rest of the aircraft 100 by a tilt mechanism 406 located towards the rear of the nacelle 404.

When integrated into a propulsion tilt mechanism in an aircraft configurable between a forward configuration and a hover configuration, cooling subsystems can advantageously utilize an increase in available airflow in a hover configuration as discussed below.

Figure 5:
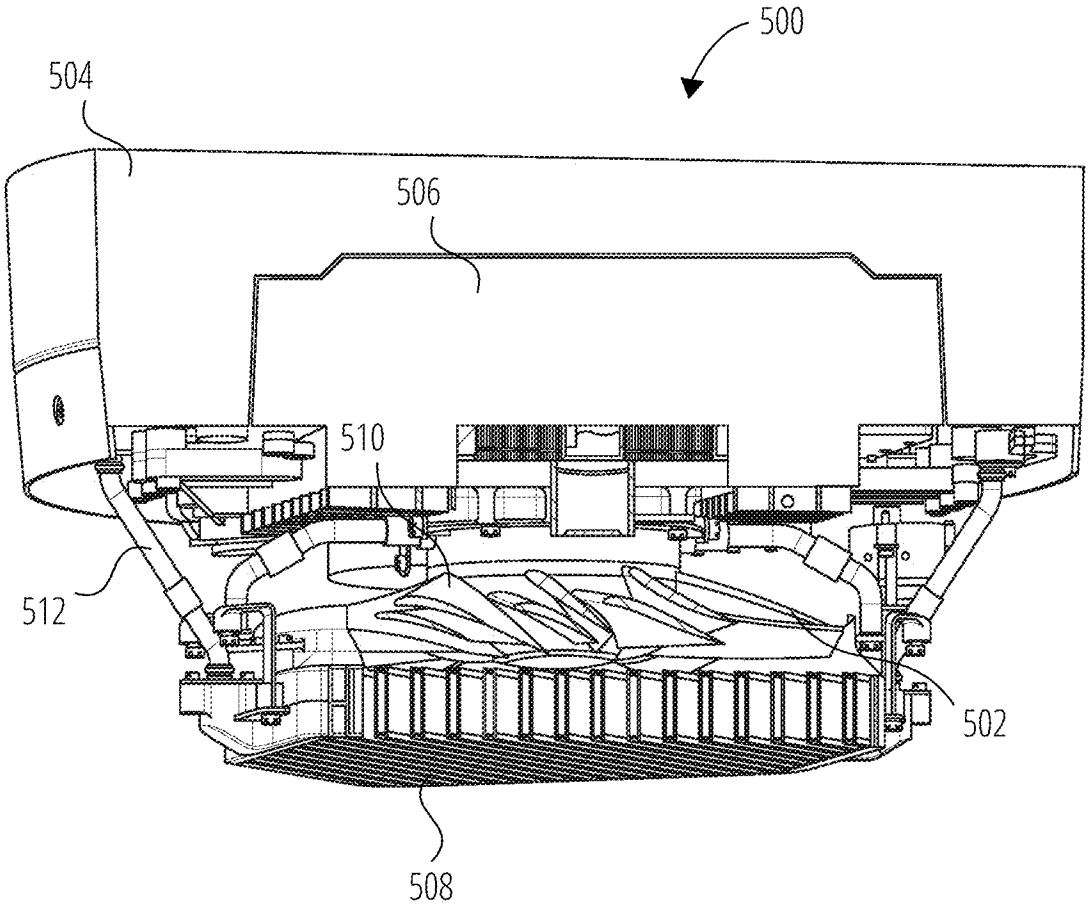
FIG. 5 illustrates a partial cross section through the aircraft propulsion system of FIG. 3 and FIG. 4 according to some examples.

FIG. 5 illustrates a partial cross section through an aircraft propulsion system 500. An inverter system 506 is nested within a radial interior of a motor 504. The aircraft propulsion system 500 also includes an integrated pump fan 502, a radiator 508 and conduits 512 forming a coolant path that passes through the motor 504, the inverter system 506 and the radiator 508. Also shown in FIG. 5 are cooling fins that provide additional cooling for the inverter system 506.

In use, the pump fan 502 circulates coolant through the radiator 508, the motor 504 and the inverter system 506, and also rotates the fan 510 to blow cooling air through the radiator 508 and over the pump fan 502, the motor 504 and the inverter system 506.

A gerotor pump is a positive displacement pump that uses an internal gear system to pump fluid. It consists of an outer gerotor (gear) and an inner gerotor (gear) that have offset axes. The inner gerotor has N number of external teeth, while the outer gerotor has N+1 number of internal teeth. As the outer gerotor moves eccentrically around the inner gerotor, the volume created between the teeth increases and decreases, creating suction and discharge.

Specifically, as the inner and outer gerotors turn, the volume between the inner gerotor and outer gerotor teeth opens up, creating a suction that draws fluid into the pump. As the rotor continues turning, the volume between the inner and outer gerotors decreases, forcing the fluid through the outlet port under pressure.

The contact between the inner and outer gerotor teeth forms sealing points that trap the fluid in the pumping chamber. As the gerotors turn, the fluid is encapsulated and transported around the pumping chamber from the inlet volume of the pumping chamber to the outlet volume of the pumping chamber, where it is expelled under pressure as the volume between the inner and outer gerotors decreases.

Figure 6:
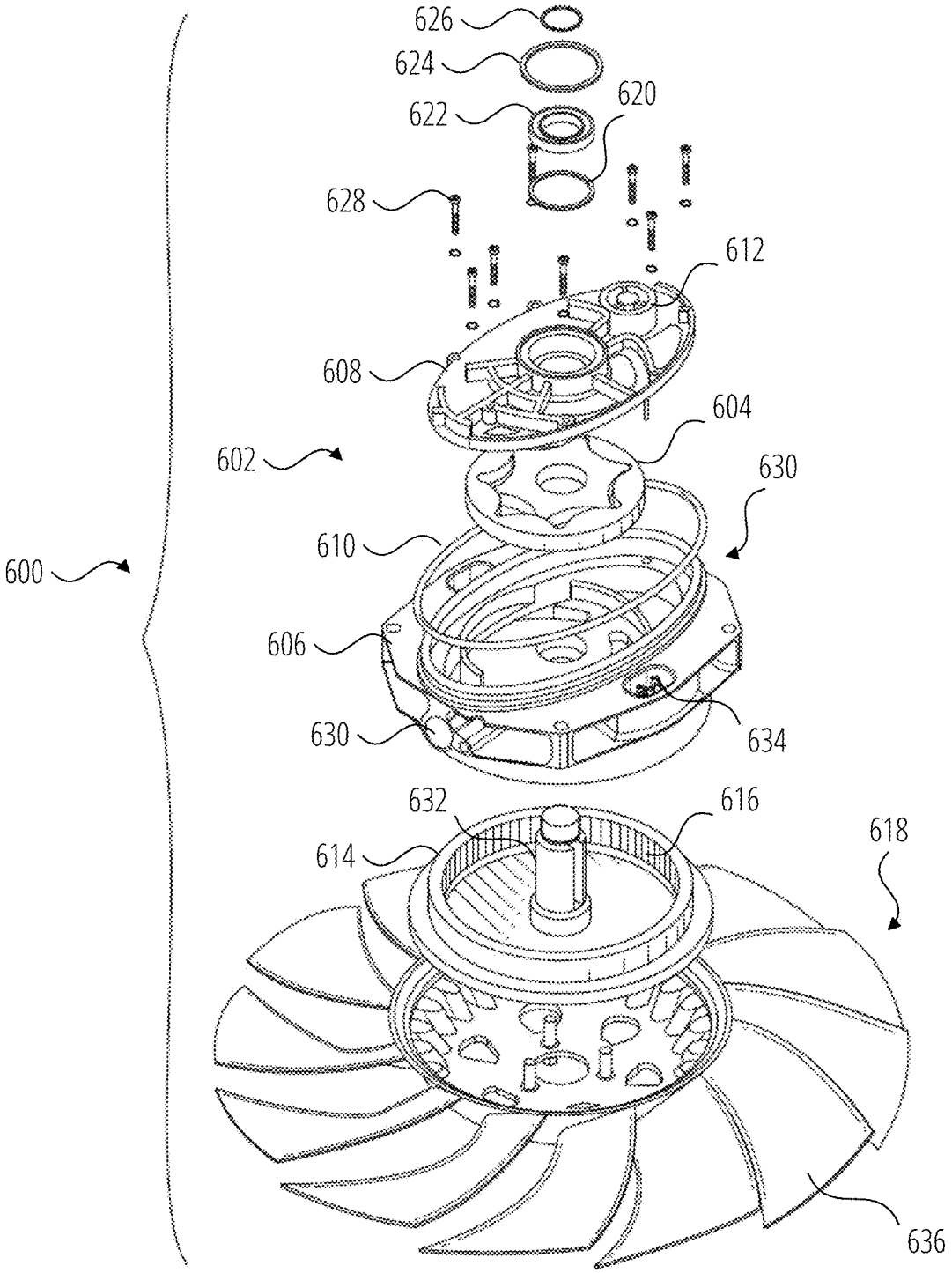
FIG. 6 is an exploded perspective view of a pump fan, according to some examples.

FIG. 6 is an exploded perspective view of a pump fan 600 corresponding to the pump fan 502, according to some examples. The pump fan 600 includes a gerotor pump 602, a pump fan rotor 614 and a fan 618. The gerotor pump 602 comprises gerotors 604, a pump housing 606, a cover 608, and an O-ring 610 to provide a seal between the pump housing 606 and the cover 608. Also provided is a wave spring 620, a bearing 622, a face seal 624 and a retaining ring 626. The pump fan 600 is held together by several bolts 628. The cover 608 includes a pressure relief valve 612, a cylindrical bearing retainer for receiving the bearing 622, and a fluid outlet port.

The pump fan rotor 614 includes a magnet assembly 616 and a shaft 632 by means of which the pump fan rotor 614 is coupled to the pump housing 606. The gerotors 604 comprise an outer gerotor 702 and an inner gerotor 704 (see FIG. 7.) The inner gerotor 704 is mounted to the shaft 632 of the pump fan rotor 614 and moves relative to the outer gerotor 702 when the pump fan rotor 614 rotates under the influence of magnetic fields created by a stator 902 (see FIG. 9), which forms part of the pump housing 606. The stator 902 is powered by electrical power received via the electrical connectors 634. As can be seen, the pump fan rotor 614 is configured as an outrunner rotor, and the electric motor formed by the stator 902 and the pump fan rotor 614 is thus an outrunner motor.

The pump housing 606 includes two pump inlets 630 in fluid communication with an inlet volume 904 of the pump housing 606 (see FIG. 9), which are diametrically opposed in some examples. In other examples, three or more pump inlets may be provided. Fluid is pumped through the gerotor pump 602 by the relative movement of the gerotors 604 caused by rotation of the pump fan rotor 614. Pumped fluid exits the gerotor pump 602 via an outlet provided in the pump housing 606.

The fan 618 includes several blades 636, which extend radially beyond the periphery of the pump fan rotor 614 and the pump housing 606 to provide circulation of air through the radiator 508 and around and over the pump fan 502, the motor 504 and the inverter system 506.

Figure 7:
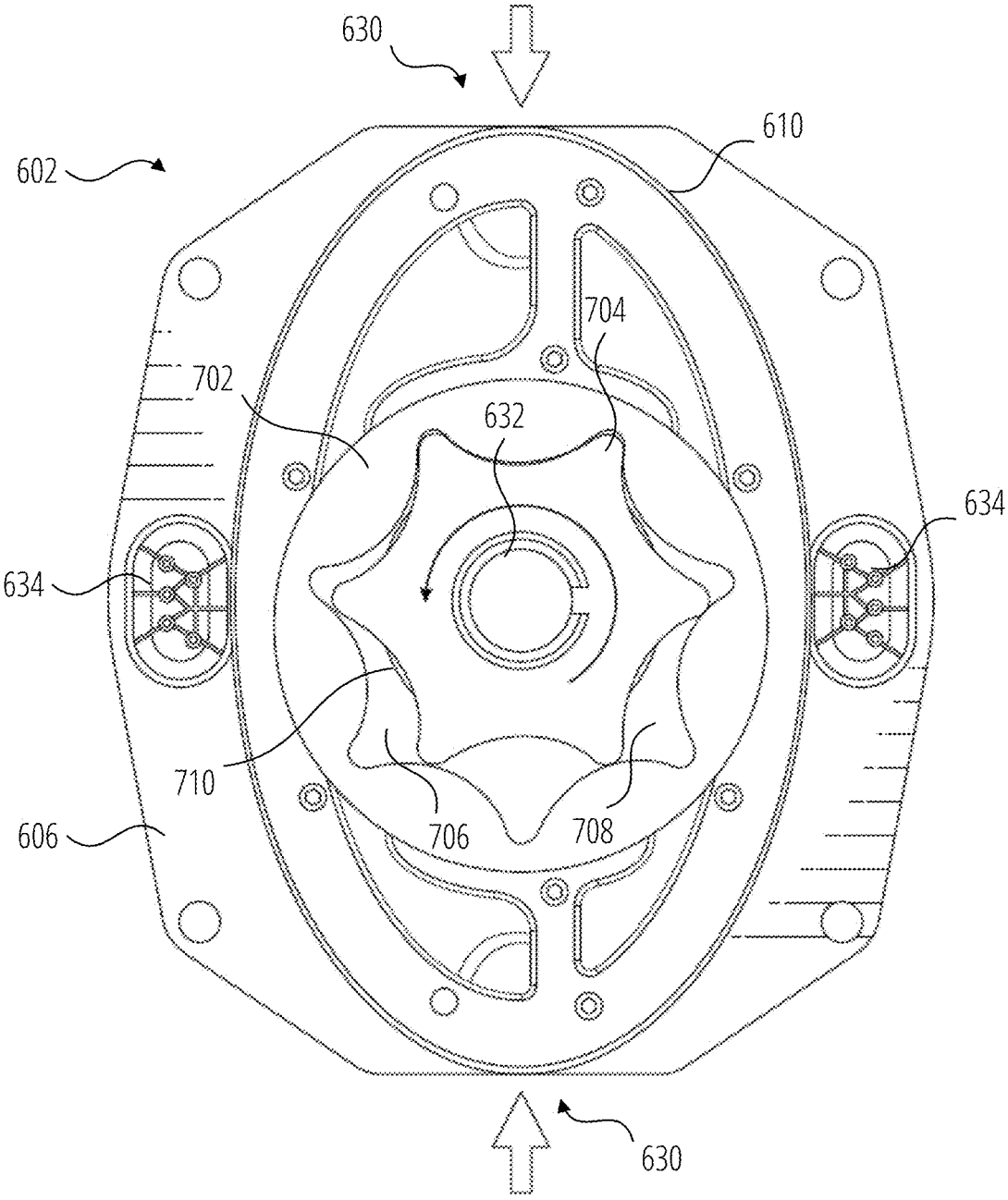
FIG. 7 is a plan view of the gerotor pump of the pump fan of FIG. 6, according to some examples.

FIG. 7 is a plan view of the gerotor pump 602 of the pump fan 600 of FIG. 6, according to some examples. As can be seen, the gerotors 604 include an outer gerotor 702 and an inner gerotor 704. The inner gerotor 704 is driven in a counterclockwise direction by the shaft 632 in use, in some examples. The outer gerotor 702 is in turn rotated by the movement of the inner gerotor. Fluid entering the gerotor pump 602 via the first and second pump inlets 630 passes into an inlet volume 904 beneath the gerotors 604 as seen in FIG. 7.

The expanding volume between the outer gerotor 702 and the inner gerotor 704 on the inlet side 706 of the gerotor pump 602 draws fluid from the inlet volume 904 beneath the gerotors into the volume between the teeth of the gerotors 604. As the gerotors 604 continue rotating, the encapsulated fluid is carried across to the outlet side 708, where the contracting volume between the outer gerotor 702 and the inner gerotor 704 on the outlet side 708 of the gerotor pump 602 pushes the fluid into an outlet volume 906 (see FIG. 9) and then out of the gerotor pump 602 through an outlet port in the cover 608.

Figure 8:
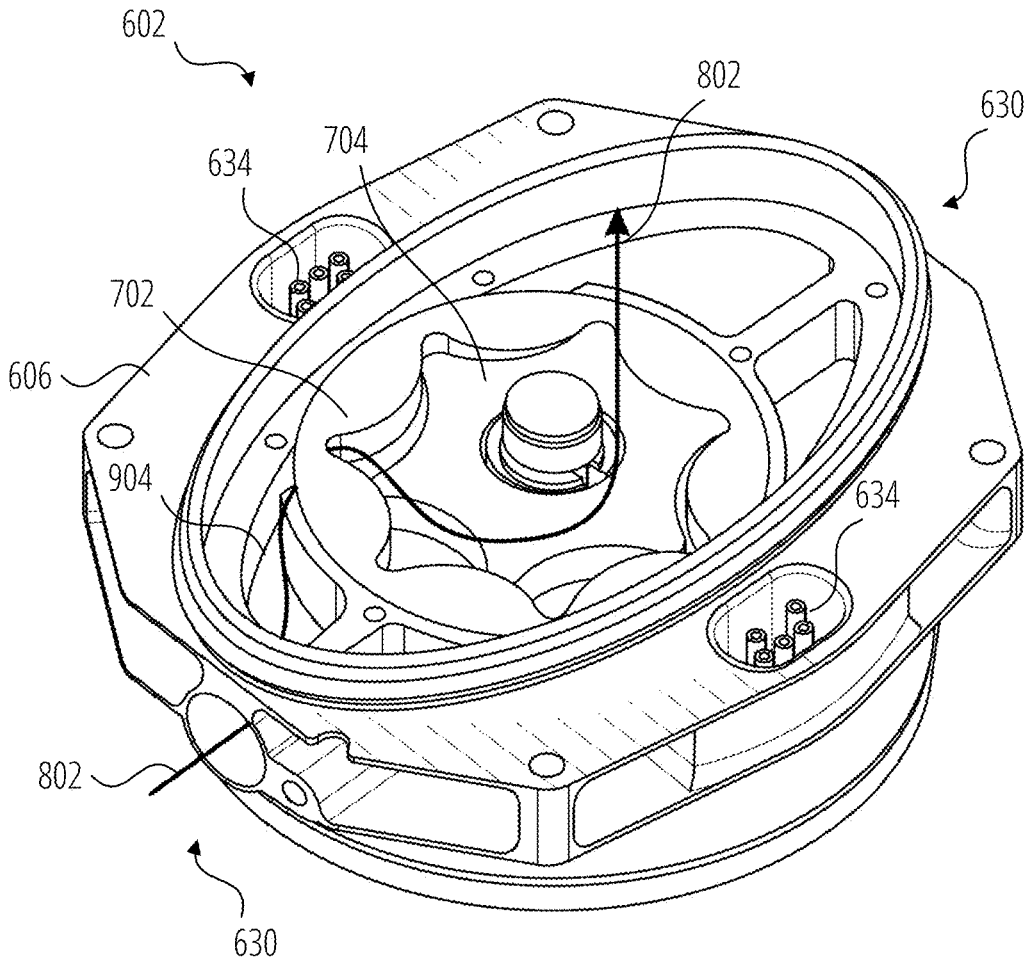
FIG. 8 is a perspective view of the gerotor pump of the pump fan of FIG. 6, according to some examples.

FIG. 8 is a perspective view of the gerotor pump 602 of the pump fan of FIG. 6, according to some examples. FIG. 8 schematically illustrates the fluid flow 802 through the gerotor pump 602 from one of the pump inlets 630. The flow from the other pump inlet 630 will be almost identical, except that it will have to travel slightly further through the pump housing 606. As can be seen, the fluid flow 802 is drawn into the pump housing 606 via the pump inlet 630 and into the inlet volume 904. It is then drawn up into a space between the inner gerotor 704 and outer gerotor 702 through a gap 710 between the pump housing 606 and the inner gerotor 704. The fluid in the space between the gerotors is then transferred across to the outlet volume 906 and then exits the gerotor pump 602 through the outlet port in the cover 608. Although the fluid flow 802 is illustrated in FIG. 8 as passing over the gerotors 604, this is merely because of the limitations associated with illustrating the operation of a device in motion. The fluid is in fact carried between the gerotors 604.

Figure 9:
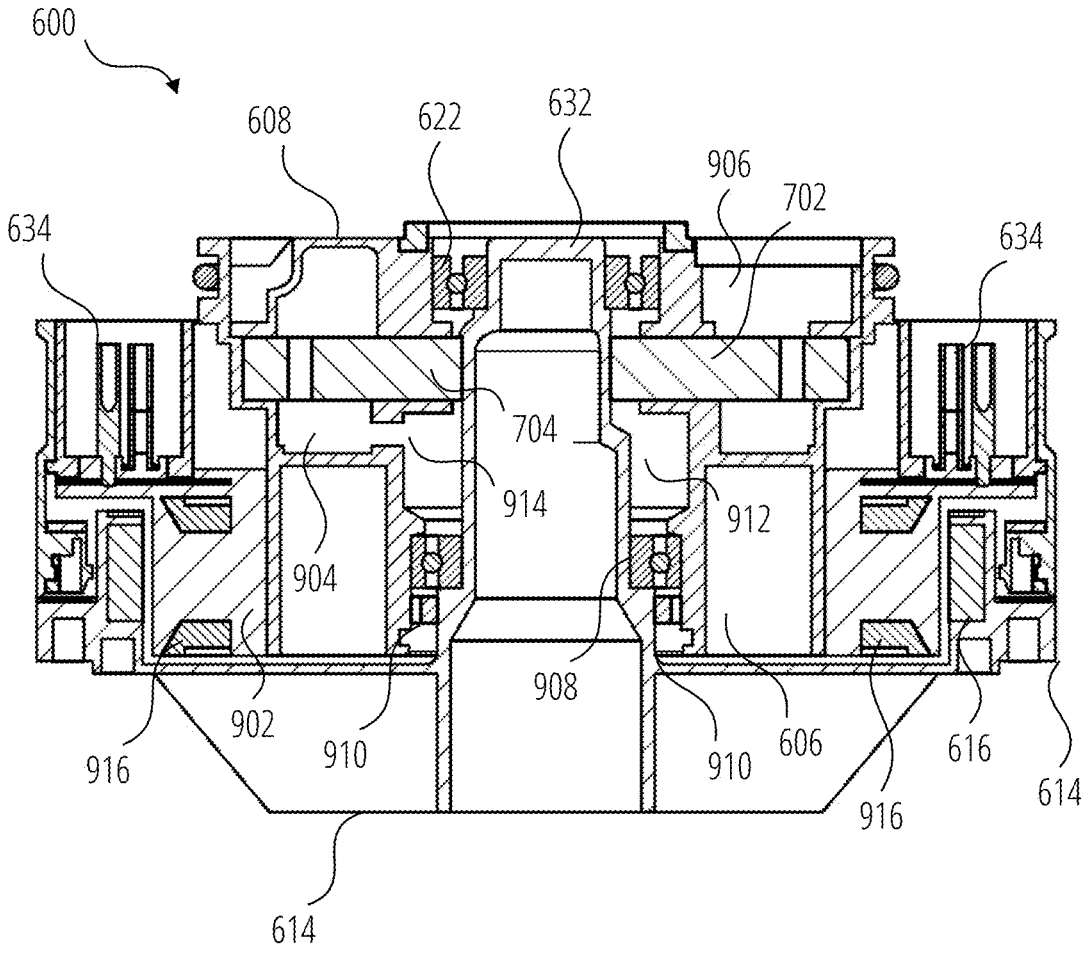
FIG. 9 is a cross-section of the pump fan of FIG. 6, according to some examples.

FIG. 9 is a cross-section of the pump fan 600 of FIG. 6, according to some examples. Illustrated in the figure are the pump housing 606, the outer gerotor 702, the inner gerotor 704, the pump fan rotor 614 and the cover 608. Also visible is the magnet assembly 616 of the pump fan rotor 614 and the electrical connectors 634 and stator 902 provided in the pump housing 606. The stator 902 includes several coils 916.

The shaft 632 of the pump fan rotor 614 is held in place by the first bearing 622 and a second bearing 908. A seal 910 is also provided between the pump housing 606 and the shaft 632. To ensure that the pressure across the seal 910 is not affected by the pressure of the fluid in the outlet volume 906 or elsewhere in the outlet side 708, an aperture 914 is provided between the inlet volume 904 and a volume 912 formed in the pump housing 606 adjacent to the shaft 632. This ensures that the pressure across the seal 910 is between ambient pressure and the fluid pressure on the inlet side 706 of the pump housing 606.

Traditional gerotor pumps are made of 4140 steel, which is hard but heavy. To provide the required hardness and durability, the gerotor pump 602 is made of lighter metals coated with a composite coating. In some examples, the pump housing 606, the cover 608 and the pump fan rotor 614 are made of aluminum with a plasma electrolytic oxidation (PEO) coating with a fluoropolymer material treatment, and the gerotors 604 are made of aluminum 7075-T651 PER AMS 4050 with a (PEO) coating with a fluoropolymer material treatment. This material selection and treatment of the outer surfaces of the components provides the required hardness and durability while saving weight over known steel gerotor pumps.

In use, an excitation current is provided to the coils 916, which generates an electromagnetic torque on the pump fan rotor 614. The resulting rotation of the pump fan rotor 614 relative to the pump housing 606 causes rotation of the gerotors 604 relative to the housing and movement of the outer gerotor 702 with respect to the inner gerotor 704 as described above. These movements of the outer gerotor 702 and the outer gerotor 702 draw cooling fluid into the diametrically-opposed pump inlets 630 in the pump housing 606, into the inlet volume 904, across to the outlet volume 906 and from there to the fluid outlet port as described above in more detail with reference to FIG. 7 to FIG. 9. Operation of the pump fan 600 also circulates coolant through the radiator 508, the motor 504 and the inverter system 506 in some examples.

Rotation of the pump fan rotor 614 also causes rotation of the fan 618, which draws air through the radiator 508 in use, and over and around the pump housing 606, the inverter system 506 and motor 504.

Various examples are contemplated. Example 1 is a fluid pump comprising: a housing having a pump inlet volume and a pump outlet volume defined therein: an outer gerotor located in the housing; and an inner gerotor located in the housing inside the outer gerotor, the inner and outer gerotors being in fluid communication with the pump inlet volume and the pump outlet volume, wherein a first inlet and a second, separate inlet are provided in fluid communication with the pump inlet volume of the housing.

In Example 2, the subject matter of Example 1 includes, a rotor for rotating the inner and outer gerotors, the rotor being coupled to the housing via a shaft; and a seal located between the shaft and the housing, the seal being in fluid communication with the pump inlet volume of the housing.

In Example 3, the subject matter of Example 2 includes, wherein the housing has a volume formed therein adjacent to the shaft, and the pump inlet volume of the housing is in fluid communication with the volume formed adjacent to the shaft by means of an aperture formed therebetween.

In Example 4, the subject matter of Examples 1-3 includes, wherein the first inlet and the second inlet are diametrically opposed in the housing.

In Example 5, the subject matter of Examples 1-4 includes, wherein the inner and outer gerotors are made of aluminum.

In Example 6, the subject matter of Example 5 includes, wherein outer surfaces of the inner and outer gerotors have a plasma electrolytic oxidation coating with a fluoropolymer material treatment.

In Example 7, the subject matter of Examples 1-6 includes, wherein the housing is made of aluminum.

In Example 8, the subject matter of Example 7 includes, a surface of the housing has a plasma electrolytic oxidation coating with a fluoropolymer material treatment.

In Example 9, the subject matter of Examples 5-8 includes, wherein the housing is made of aluminum.

In Example 10, the subject matter of Example 9 includes, wherein outer surfaces of the inner and outer gerotors have a plasma electrolytic oxidation coating with a fluoropolymer material treatment.

In Example 11, the subject matter of Example 10 includes, wherein the surface of the housing has a plasma electrolytic oxidation coating with a fluoropolymer material treatment.

Example 12 is a fluid pump comprising: a housing having a pump inlet volume and a pump outlet volume defined therein: an outer gerotor located in the housing; an inner gerotor located in the housing inside the outer gerotor, the inner and outer gerotors being in fluid communication with the pump inlet volume and the pump outlet volume, wherein a first inlet and a second, separate inlet are provided in fluid communication with the pump inlet volume of the housing; a rotor coupled to the housing and to the inner gerotor via a shaft; and a fan coupled to the rotor, the fan including blades extending radially beyond the housing.

In Example 13, the subject matter of Example 12 includes, a seal located between the shaft and the housing, the seal being in fluid communication with the pump inlet volume of the housing.

In Example 14, the subject matter of Example 13 includes, wherein the housing has a volume formed therein adjacent to the shaft, and the pump inlet volume of the housing is in fluid communication with the volume formed adjacent to the shaft by means of an aperture formed therebetween.

In Example 15, the subject matter of Examples 12-14 includes, wherein the first inlet and the second inlet are diametrically opposed in the housing.

In Example 16, the subject matter of Examples 12-15 includes, wherein the inner and outer gerotors are made of aluminum.

In Example 17, the subject matter of Example 16 includes, wherein outer surfaces of the inner and outer gerotors have a plasma electrolytic oxidation coating with a fluoropolymer material treatment.

In Example 18, the subject matter of Examples 12-17 includes, wherein the housing is made of aluminum.

In Example 19, the subject matter of Example 18 includes, a surface of the housing has a plasma electrolytic oxidation coating with a fluoropolymer material treatment.

In Example 20, the subject matter of Examples 16-19 includes, wherein the rotor further comprises a plurality of magnets and the housing further comprises a plurality of stator coils, the rotor and the housing together forming an outrunner motor.

Example 21 is at least one machine-readable medium including instructions that, when executed by processing circuitry, cause the processing circuitry to perform operations to implement of any of Examples 1-20.

Example 22 is an apparatus comprising means to implement of any of Examples 1-20. Example 23 is a system to implement of any of Examples 1-20. Example 24 is a method to implement of any of Examples 1-20.

Embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

The term "rotor" as utilized herein when referring to a thrust-generating element, can refer to a rotor, a propeller, and/or any other suitable rotary aerodynamic actuator. While a rotor can refer to a rotary aerodynamic actuator that makes use of an articulated or semi-rigid hub (e.g., wherein the connection of the blades to the hub can be articulated, flexible, rigid, and/or otherwise connected), and a propeller can refer to a rotary aerodynamic actuator that makes use of a rigid hub (e.g., wherein the connection of the blades to the hub can be articulated, flexible, rigid, and/or otherwise connected), no such distinction is explicit or implied when used herein, and the usage of "rotor" can refer to either configuration, and any other suitable configuration of articulated or rigid blades, and/or any other suitable configuration of blade connections to a central member or hub. Likewise, the usage of "propeller" can refer to either configuration, and any other suitable configuration of articulated or rigid blades, and/or any other suitable configuration of blade connections to a central member or hub. Accordingly, the tiltrotor aircraft can be referred to as a tilt-propeller aircraft, a tilt-prop aircraft, and/or otherwise suitably referred to or described.

The term "board" as utilized herein, in reference to the control board, inverter board, or otherwise, preferably refers to a circuit board. More preferably, "board" refers to a printed circuit board (PCB) and/or electronic components assembled thereon, which can collectively form a printed circuit board assembly (PCBA). In a first example, the control board is a PCBA. In a second example, each inverter board is a PCBA. However, "board" can additionally or alternatively refer to a single sided PCB, double sided PCB, multi-layer PCB, rigid PCB, flexible PCB, and/or can have any other suitable meaning.

The aircraft can include any suitable form of power storage or power storage unit (battery, flywheel, ultracapacitor, hydrogen fuel cell, fuel tank, etc.) that powers the actuator(s) (e.g., rotor/propeller, tilt mechanism, blade pitch mechanism, cooling systems, etc.). The preferred power/fuel source is a battery, however the system could reasonably be employed with any suitable power/fuel source. The aircraft can include auxiliary and/or redundant power sources (e.g., backup batteries, multiple batteries) or exclude redundant power sources. The aircraft can employ batteries with any suitable cell chemistries (e.g., Li-ion, nickel cadmium, etc.) in any suitable electrical architecture or configuration (e.g., multiple packs, bricks, modules, cells, etc.; in any combination of series and/or parallel architecture).

In a specific example, the system integrated into an electric tiltrotor aircraft including a plurality of tiltable rotor assemblies (e.g., six tiltable rotor assemblies). The electric tiltrotor aircraft can operate as a fixed wing aircraft, a rotary-wing aircraft, and in any liminal configuration between a fixed and rotary wing state (e.g., wherein one or more of the plurality of tiltable rotor assemblies is oriented in a partially rotated state). The control system of the electric tiltrotor aircraft in this example can function to command and control the plurality of tiltable rotor assemblies within and/or between the fixed wing arrangement and the rotary-wing arrangement.

The term "substantially" as utilized herein can mean: exactly, approximately, within a predetermined threshold or tolerance, and/or have any other suitable meaning.

Alternative embodiments implement the above methods and/or processing modules m non-transitory computer-readable media, storing computer-readable instructions. The instructions can be executed by computer-executable components integrated with the computer-readable medium and/or processing system. The computer-readable medium may include any suitable computer readable media such as RAMs, ROMs, flash memory, EEPROMs, optical devices (CD or DVD), hard drives, floppy drives, non-transitory computer readable media, or any suitable device. The computer-executable component can include a computing system and/or processing system (e.g., including one or more collocated or distributed, remote or local processors) connected to the non-transitory computer-readable medium, such as CPUs, GPUs, TPUS, microprocessors, or ASICs, but the instructions can alternatively or additionally be executed by any suitable dedicated hardware device.

Embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

As a person skilled in the art will recognize from the previous detailed description and from the figures and claims, modifications and changes can be made to the examples of the invention without departing from the scope of this invention defined in the following claims.

What is claimed is:

1. A fluid pump comprising:

a housing having a pump inlet volume and a pump outlet volume defined therein:

an outer gerotor located in the housing;

an inner gerotor located in the housing inside the outer gerotor, the inner and outer gerotors being in fluid communication with the pump inlet volume and the pump outlet volume, wherein a first inlet and a separate second inlet are provided in fluid communication with the pump inlet volume of the housing;

a rotor for rotating the inner and outer gerotors, the rotor being coupled to the housing via a shaft; and a seal located between the shaft and the housing, the seal being in fluid communication with the pump inlet volume of the housing.

2. The fluid pump of claim 1, wherein the housing has a volume formed therein adjacent to the shaft, and the pump inlet volume of the housing is in fluid communication with the volume formed adjacent to the shaft by means of an aperture formed therebetween.

3. The fluid pump of claim 1, wherein the first inlet and the second inlet are diametrically opposed in the housing.

4. The fluid pump of claim 1, wherein the inner and outer gerotors are made of aluminum.

5. The fluid pump of claim 4, wherein outer surfaces of the inner and outer gerotors have a plasma electrolytic oxidation coating with a fluoropolymer material treatment.

6. The fluid pump of claim 1, wherein the housing is made of aluminum.

7. The fluid pump of claim 6, a surface of the housing has a plasma electrolytic oxidation coating with a fluoropolymer material treatment.

8. The fluid pump of claim 4, wherein the housing is made of aluminum.

9. The fluid pump of claim 8, wherein outer surfaces of the inner and outer gerotors have a plasma electrolytic oxidation coating with a fluoropolymer material treatment.

10. The fluid pump of claim 9, wherein the surface of the housing has a plasma electrolytic oxidation coating with a fluoropolymer material treatment.

11. A fluid pump comprising:

a housing having a pump inlet volume and a pump outlet volume defined therein:

an outer gerotor located in the housing;

an inner gerotor located in the housing inside the outer gerotor, the inner and outer gerotors being in fluid communication with the pump inlet volume and the pump outlet volume, wherein a first inlet and a separate second inlet are provided in fluid communication with the pump inlet volume of the housing;

a rotor coupled to the housing and to the inner gerotor via a shaft; and a fan coupled to the rotor, the fan including blades extending radially beyond the housing.

12. The fluid pump of claim 11, further comprising:

a seal located between the shaft and the housing, the seal being in fluid communication with the pump inlet volume of the housing.

13. The fluid pump of claim 12, wherein the housing has a volume formed therein adjacent to the shaft, and the pump inlet volume of the housing is in fluid communication with the volume formed adjacent to the shaft by means of an aperture formed therebetween.

14. The fluid pump of claim 11, wherein the first inlet and the second inlet are diametrically opposed in the housing.

15. The fluid pump of claim 11, wherein the inner and outer gerotors are made of aluminum.

16. The fluid pump of claim 15, wherein outer surfaces of the inner and outer gerotors have a plasma electrolytic oxidation coating with a fluoropolymer material treatment.

17. The fluid pump of claim 11, wherein the housing is made of aluminum.

18. The fluid pump of claim 17, a surface of the housing has a plasma electrolytic oxidation coating with a fluoropolymer material treatment.

19. The fluid pump of claim 15, wherein the rotor further comprises a plurality of magnets and the housing further comprises a plurality of stator coils, the rotor and the housing together forming an outrunner motor.

* * * * *